US008905471B2

(12) United States Patent
Tang

(10) Patent No.: US 8,905,471 B2
(45) Date of Patent: Dec. 9, 2014

(54) COLLAPSIBLE CHAIR WITH TABLE

(71) Applicant: Cohesion Products, Inc., Foothill Ranch, CA (US)

(72) Inventor: Gerald Tang, Shanghai (CN)

(73) Assignee: Cohesion Products, LLC, Irving, TX (US)

( * ) Notice: Subject to any disclaimer, the term of this patent is extended or adjusted under 35 U.S.C. 154(b) by 64 days.

(21) Appl. No.: 13/655,806

(22) Filed: Oct. 19, 2012

(65) Prior Publication Data

US 2014/0110976 A1 Apr. 24, 2014

(51) Int. Cl.

| | |
|---|---|
| ***A47C 7/70*** | (2006.01) |
| ***A47C 4/28*** | (2006.01) |
| ***A47C 4/30*** | (2006.01) |
| ***A47C 5/10*** | (2006.01) |
| ***A47C 7/68*** | (2006.01) |

(52) U.S. Cl.
CPC .... *A47C 5/10* (2013.01); *A47C 7/68* (2013.01)
USPC ..... 297/173; 297/31; 297/45; 297/160; 297/162; 297/170; 297/452.56

(58) Field of Classification Search
CPC ..... A47C 7/70
USPC ..... 297/31, 45, 135–173, 452.56
See application file for complete search history.

(56) References Cited

U.S. PATENT DOCUMENTS

| | | | | | |
|---|---|---|---|---|---|
| 2,195,091 | A | * | 3/1940 | Lorenz et al. | 297/27 |
| 2,447,391 | A | * | 8/1948 | Brandes et al. | 297/45 |
| 2,560,985 | A | * | 7/1951 | Rideout | 297/82 |
| 2,571,463 | A | * | 10/1951 | Lorenz | 297/29 |
| 2,638,970 | A | * | 5/1953 | Harber | 297/39 |
| 2,710,645 | A | * | 6/1955 | Luckhardt | 297/38 |
| 2,761,492 | A | * | 9/1956 | Rechler | 297/30 |
| 2,994,366 | A | * | 8/1961 | Hoch | 297/162 X |
| 3,025,103 | A | * | 3/1962 | Mohror | 297/171 |
| 3,166,354 | A | * | 1/1965 | Sorensen | 297/160 |
| 3,239,272 | A | * | 3/1966 | Wilkins | 297/160 |
| 3,265,436 | A | * | 8/1966 | La Bombard et al. | 297/162 |
| 3,267,887 | A | * | 8/1966 | Boyd | 108/152 |
| 3,586,367 | A | * | 6/1971 | Cincotta | 297/162 |
| 3,894,496 | A | * | 7/1975 | Phillips et al. | 297/135 X |
| 4,003,598 | A | * | 1/1977 | Glaze | 297/161 |
| 4,063,701 | A | * | 12/1977 | Wray | 297/188.2 X |
| 4,072,341 | A | * | 2/1978 | Kurz | 297/27 |
| 4,213,649 | A | * | 7/1980 | Sell | 297/188.02 |
| 4,300,798 | A | * | 11/1981 | Musgrove et al. | 297/162 X |
| 4,792,181 | A | * | 12/1988 | Guichon | 297/28 |
| 4,798,413 | A | * | 1/1989 | Capelli | 297/161 |
| 4,861,102 | A | * | 8/1989 | Fuller | 297/162 |
| 5,251,956 | A | * | 10/1993 | Hofmeyer | 297/173 |
| D346,516 | S | * | 5/1994 | D'Anna et al. | D6/511 |
| 5,356,107 | A | * | 10/1994 | Sinohuiz | 297/188.18 X |
| 5,464,270 | A | * | 11/1995 | Chang | 297/81 |
| 5,564,779 | A | * | 10/1996 | Tolbert et al. | 297/144 |
| 5,570,926 | A | * | 11/1996 | Papiernik et al. | 297/39 |
| 5,855,409 | A | * | 1/1999 | Tseng | 297/35 |
| 5,865,124 | A | * | 2/1999 | Wroe | 297/170 X |
| 5,873,624 | A | * | 2/1999 | Simpson | 297/45 |

(Continued)

*Primary Examiner* — Rodney B White

(74) *Attorney, Agent, or Firm* — The Eclipse Group LLP

(57) ABSTRACT

A self-storing table that is pivotally mounted to a collapsible chair such that when the self-storing table is down, it does not interfere with the closing of the collapsible chair.

20 Claims, 6 Drawing Sheets

(56) References Cited

U.S. PATENT DOCUMENTS

| | | | | |
|---|---|---|---|---|
| 6,017,085 | A * | 1/2000 | LaCroix et al. | 297/173 |
| 6,030,032 | A * | 2/2000 | Tseng | 297/38 |
| 6,082,820 | A * | 7/2000 | Jeng | 297/326 |
| 6,364,411 | B1 * | 4/2002 | Zheng | 297/173 |
| 6,412,861 | B1 * | 7/2002 | Herman et al. | 297/146 |
| 6,439,659 | B1 * | 8/2002 | Neubauer, Jr. | 297/45 X |
| 6,691,627 | B2 * | 2/2004 | Einsel et al. | 297/160 X |
| 6,692,068 | B1 * | 2/2004 | Tang | 297/16.2 |
| 6,755,463 | B2 * | 6/2004 | Lardieri et al. | 297/35 |
| 6,764,132 | B1 * | 7/2004 | Gaertner | 297/155 X |
| 6,902,231 | B1 * | 6/2005 | Tseng | 297/27 |
| 6,976,737 | B1 * | 12/2005 | Dandolo | 297/218.3 |
| 7,063,380 | B1 * | 6/2006 | Cui | 297/30 |
| 7,156,456 | B1 * | 1/2007 | Chen | 297/32 |
| 7,185,948 | B2 * | 3/2007 | Liu | 297/30 |
| 7,243,991 | B2 * | 7/2007 | Ojeda | 297/135 X |
| 7,407,229 | B1 * | 8/2008 | Chen | 297/259.2 |
| 7,500,715 | B1 * | 3/2009 | Chen | 297/27 |
| 7,628,450 | B2 * | 12/2009 | Castagnola et al. | 297/38 |
| 7,950,734 | B2 * | 5/2011 | Zheng | 297/28 |
| 8,333,428 | B2 * | 12/2012 | Zhu et al. | 297/144 |
| 8,419,134 | B1 * | 4/2013 | Yuan | 297/410 |
| 8,636,317 | B2 * | 1/2014 | Wu | 297/19 |
| 2002/0125745 | A1 * | 9/2002 | Lee | 297/30 |
| 2007/0216201 | A1 * | 9/2007 | Hart | 297/162 |
| 2011/0227374 | A1 | 9/2011 | Zhu et al. | |

* cited by examiner

COLLAPSIBLE CHAIR WITH TABLE

BACKGROUND OF THE INVENTION

1. Field of the Invention

This invention relates generally to folding chairs, and in particular, a collapsible chair having a tray table.

2. Related Art

Often when people are enjoying outdoor events they bring and use collapsible chairs, commonly referred to as lawn chairs. One of the features of a collapsible chair is the ability to fold the chair for storage and transportation. Many different variations of collapsible chairs have been created that mimic traditional chairs, such as rocking chair, chaise lounges, and four legged chairs. But, when people are sitting outside they often have drinks or food that need to be set down on something.

Some past approaches have been to simply balance plates and drinks in your lap as you are seated, attach cup holders to the frame of the chair, or mold cup holders into the handle of the collapsible chair. But, the lap proves impractical because movement is limited and items tend to slip off a person's lap. Cup holders do not provide a person a place to set plates or other items larger than a cup or can and if attached to the frame of a collapsible chair, restricts movement of the chair when attempting to close the collapsible chair.

Therefore, there is a need for an approach for having a table attached to a collapsible chair such that the collapsible chair may easily open and close.

SUMMARY

Systems and methods consistent with the present invention provide an approach for having a table pivotally attached to a collapsible chair. The table has a first position when the collapsible chair is in a closed position and may be in a second position when the collapsible chair is in an open position. In the second position, the table is able to support plates and other items.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Unlike the known approaches previously discussed, a collapsible chair with a self-storing table is described.

Figure 1:
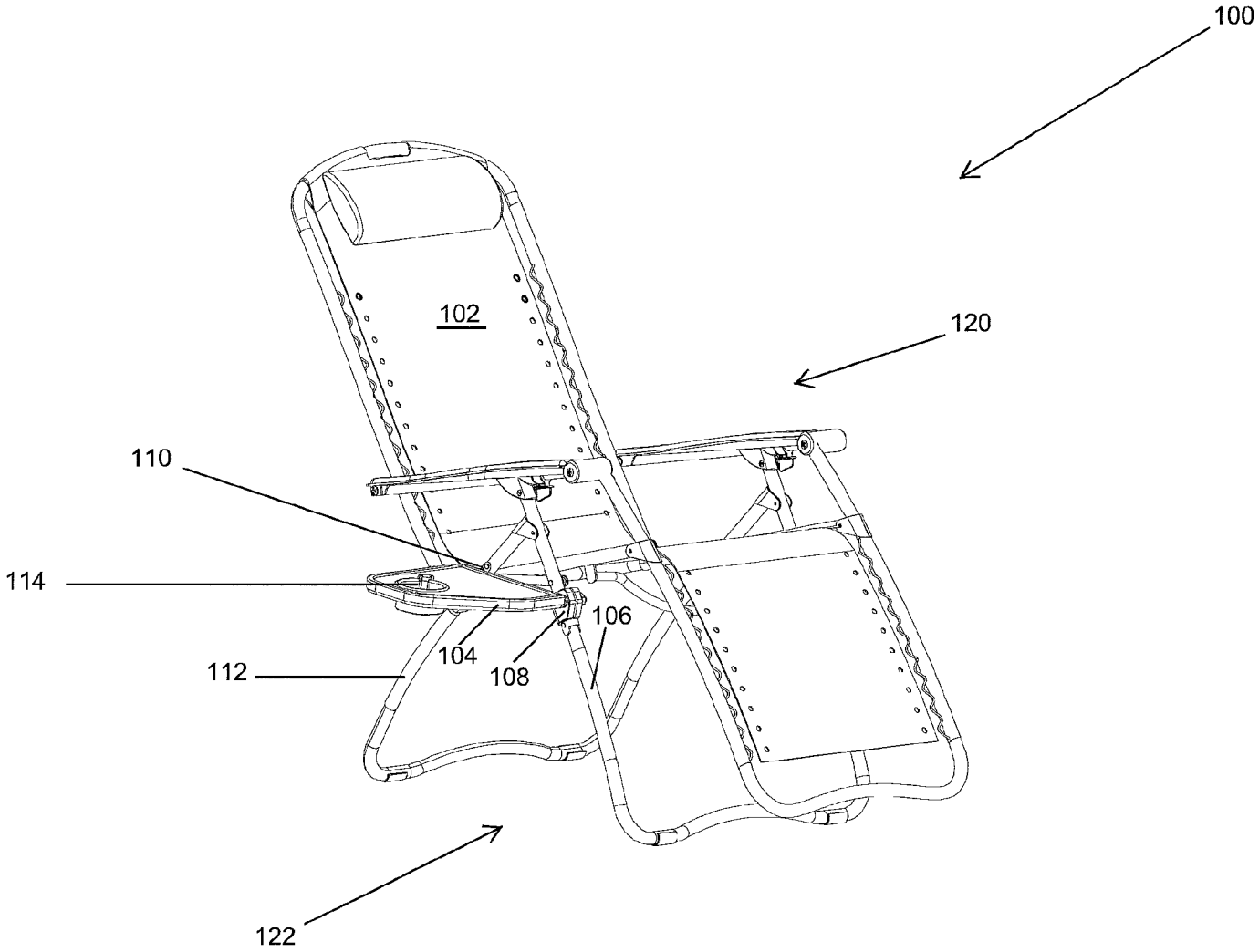
FIG. 1 illustrates a perspective view of a collapsible chair having a self-storing table in accordance with an example implementation of the invention.

Turning first to FIG. 1, an illustration 100 of an assembly perspective view of the collapsible chair 102 of FIG. 1 with a self-storing table 104 in accordance with the example implementation of the invention is shown. The particular type of collapsible chair depicted in this implementation is a zero gravity chair. The term zero gravity positioning relates to the orientation of the legs above the level of the heart. It is also called the "90-90" position and the Trendleberg position. The latter term is commonly used in hospitals when a bed is positioned with the legs elevated in order to reduce tension and improve blood circulation. The term "zero gravity," or "Z.G.," stems from suggestions that the human body naturally assumes a similar orientation with respect to the legs when relaxed and suspended in weightlessness.

A zero gravity chair generally holds an occupant in a position where the angle between the legs and the torso may be greater than 90 degrees. Typically, when the chair is in the zero gravity position, the legs are elevated such that the legs are even with or above the occupant's heart. The disclosed zero gravity chair provides the occupant with the ability to vary the angle between a seat and a back sections and to rotate the seat and the back section together as a unit about a horizontal axis.

The collapsible chair 102 comprises a seat frame 120 for supporting a user to sit on the foldable chair, a leg frame 122, and the self-storing table 104. The leg frame 122 comprises a front frame member 106 and a rear frame member 112 pivotally connected with each other and the seat frame 120 for moving between a folded or closed position and an unfolded or open position, wherein in the folded position, the frame members 106 and 112 and the seat frame 120 are folded toward each other for forming a compact structure, wherein in the unfolded position, the frame members 106 and 112 and the seat frame 120 are pivotally unfolded to support the seat frame 120 at a position above the leg frame 122.

As shown, the collapsible chair 102 is in an open position with the self-storing table 104 set in an up (first) position. The self-storing table 104 may be pivotally attached to front frame member 106 of the collapsible chair 102 with bracket 108. The bracket 108 enables the self-storing table 104 to pivot in an up and down direction and a right and left direction. In addition to the self-storing table 104 being secured to the frame 106 by bracket 108, the self-storing table 104 in the first position may be removable connected with connector 110 to frame member 112.

The self-storing table 104 may be made out of wood, plastic, metal, or other polymer type material with plastic or polymer material being preferred because of weight considerations. The self-storing table 104 may also have a drink holder 114 formed into the table. In other implementations, the drink holder 114 may be attached to the self-storing table 104. The frame members 106 and 112 may be made out of aluminum, polymer, or similar material, with the preferred material being aluminum. The bracket 108 and connector 110 may be made out of metal (such as aluminum), plastic or other polymer, with the preferred material being a metal bolt that the self-storing table hooks on.

Figure 2:
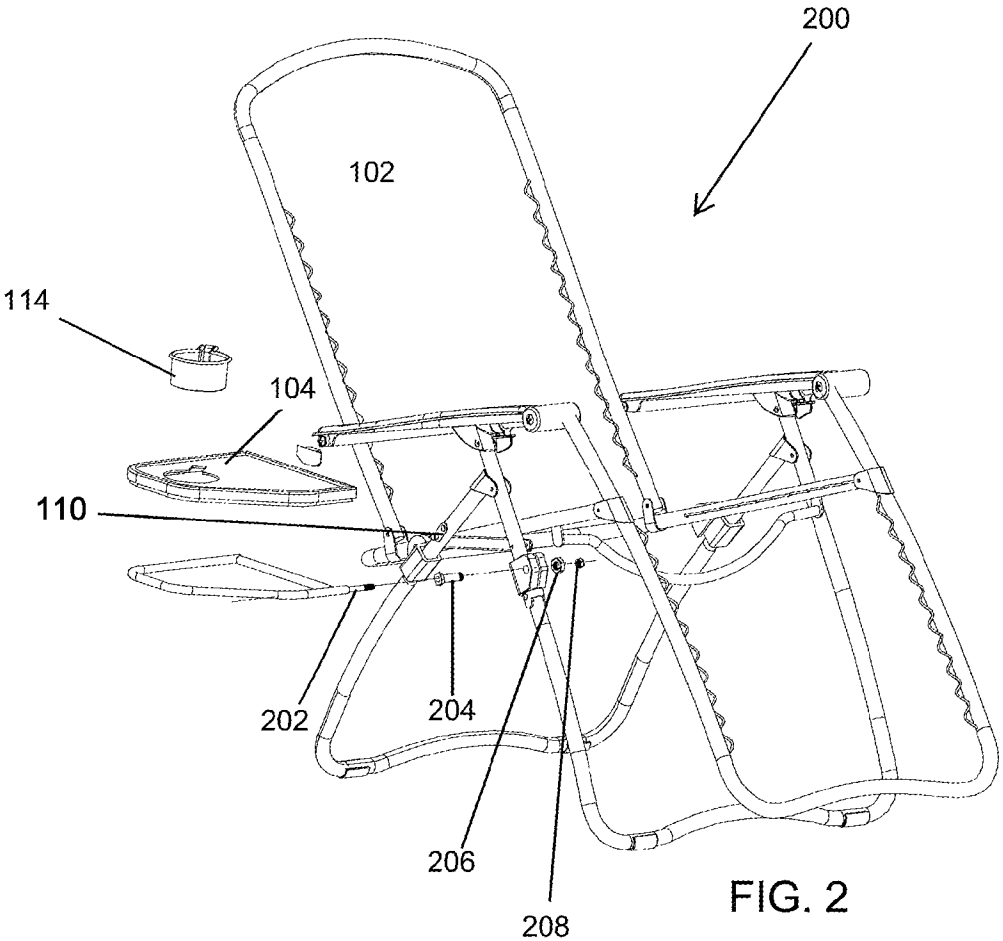
FIG. 2 illustrates an assembly perspective view of the collapsible chair of FIG. 1 with a self-storing table in accordance with the example implementation of the invention.

In FIG. 2 an illustration of an assembly perspective 200 view of the collapsible chair 102 of FIG. 1 with the self-storing table 104 in accordance with the example implementation of the invention is shown. The self-storing table 104 may have a threaded rod 202 that extends through a grommet 204 that may extend through bracket 108. The threaded rod 202 may be secured by a washer 206 and nut 208. The self-storing table 104 is shown with the cup holder 114 being removable. The cup holder 114 may be removed for cleaning or if ever damaged, it may be replaced.

Figure 3:
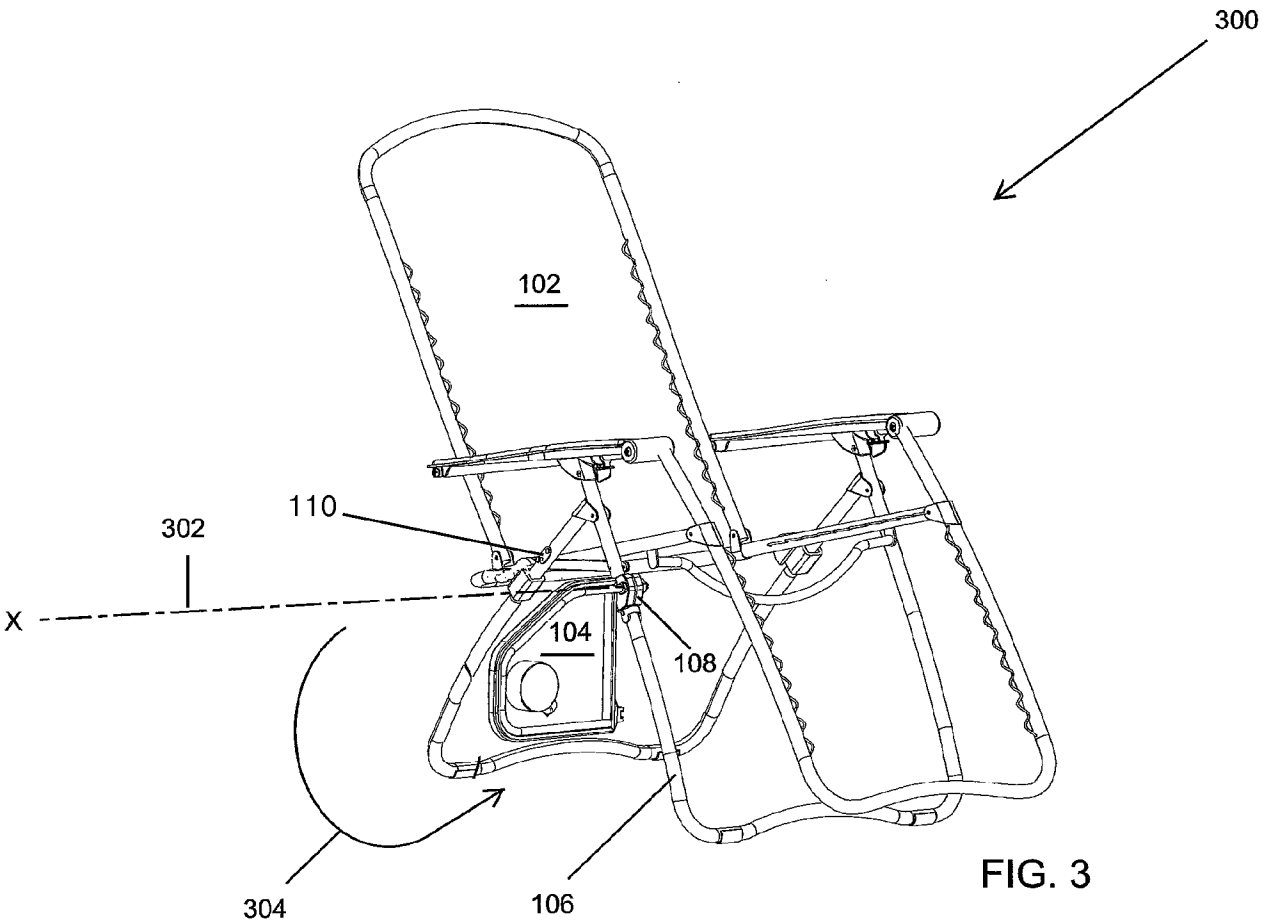
FIG. 3 illustrates a perspective view of the collapsible chair of FIG. 1 with the self-storing table in transition from a first position to a second position in accordance with the example implementation of the invention.

Turning to FIG. 3, an illustration of a perspective view of the collapsible chair 102 of FIG. 1 with the self-storing table 104 in transition 302 from a first position to a second position in accordance with the example implementation of the invention is shown. The self-storing table is disconnected from connector 110 and pivoted about a first axis or X-axis 302, transverse to a central axis of first frame member 106, using bracket 108 in a downward or counterclockwise direction 302.

Figure 4:
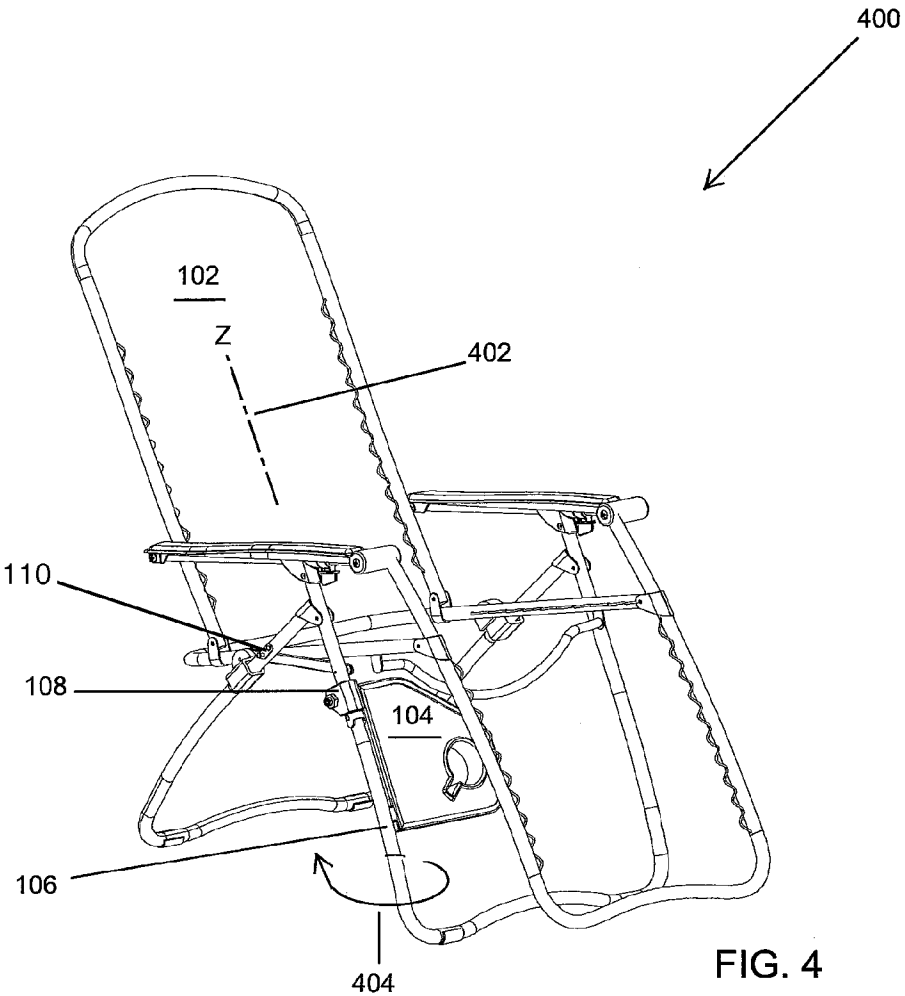
FIG. 4 illustrates a perspective view of the collapsible chair of FIG. 1 with the self-storing table in a second position in accordance with the example implementation of the invention.

In FIG. 4, an illustration of a perspective view 400 of the collapsible chair 102 of FIG. 1 with the self-storing table 104 in a second position in accordance with the example implementation of the invention is shown. The self-storing table 104 has pivoted along with at least a portion of bracket 108 generally about a Z-axis 402 central to first frame member 106 in a counterclockwise direction 404. In the second position, the table is out of the way and does not adversely affect the use of the collapsible chair 102 in the open position.

Figure 5:
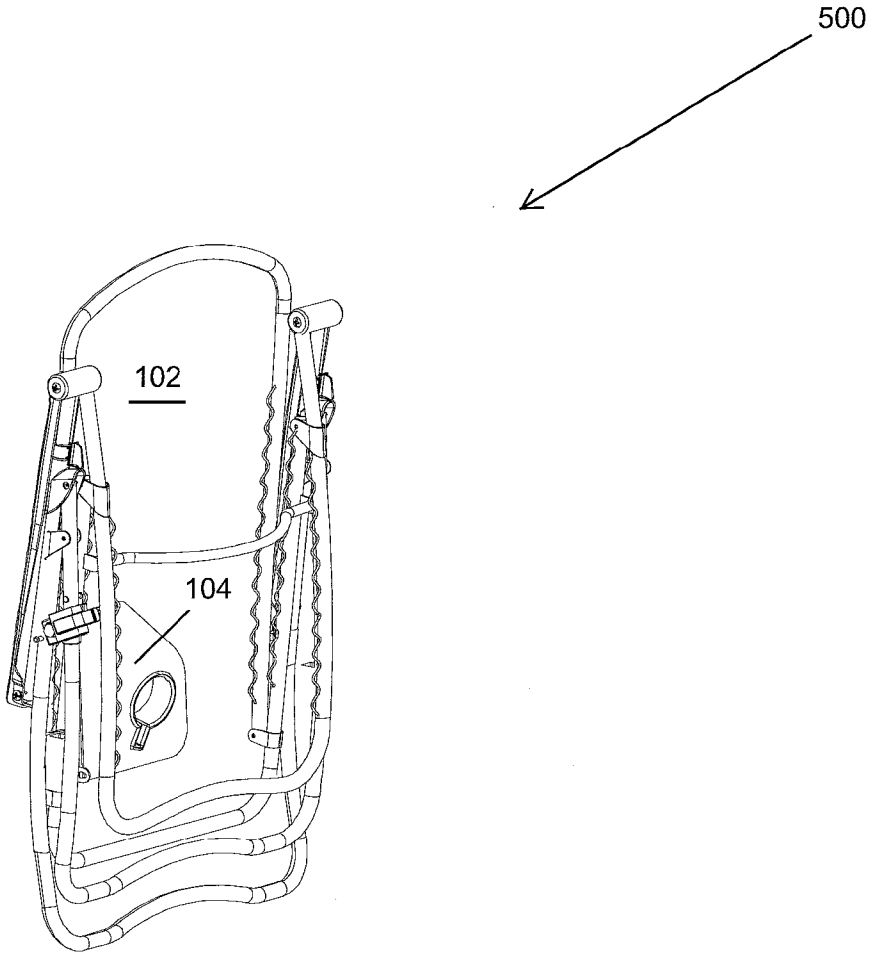
FIG. 5 illustrates a perspective view of the collapsible chair of FIG. 1 with the self-storing table in the second position and the collapsible chair in the closed position in accordance with another example implementation of the invention.

Turning to FIG. 5, an illustration of a perspective view 500 of the collapsible chair 102 of FIG. 1 with the self-storing table 104 in the second position and the collapsible chair 102 in the closed position in accordance with another example implementation of the invention. The closing of the collapsible chair 102 is not hindered or affected by the self-storing table 104 when in the second position.

Figure 6:
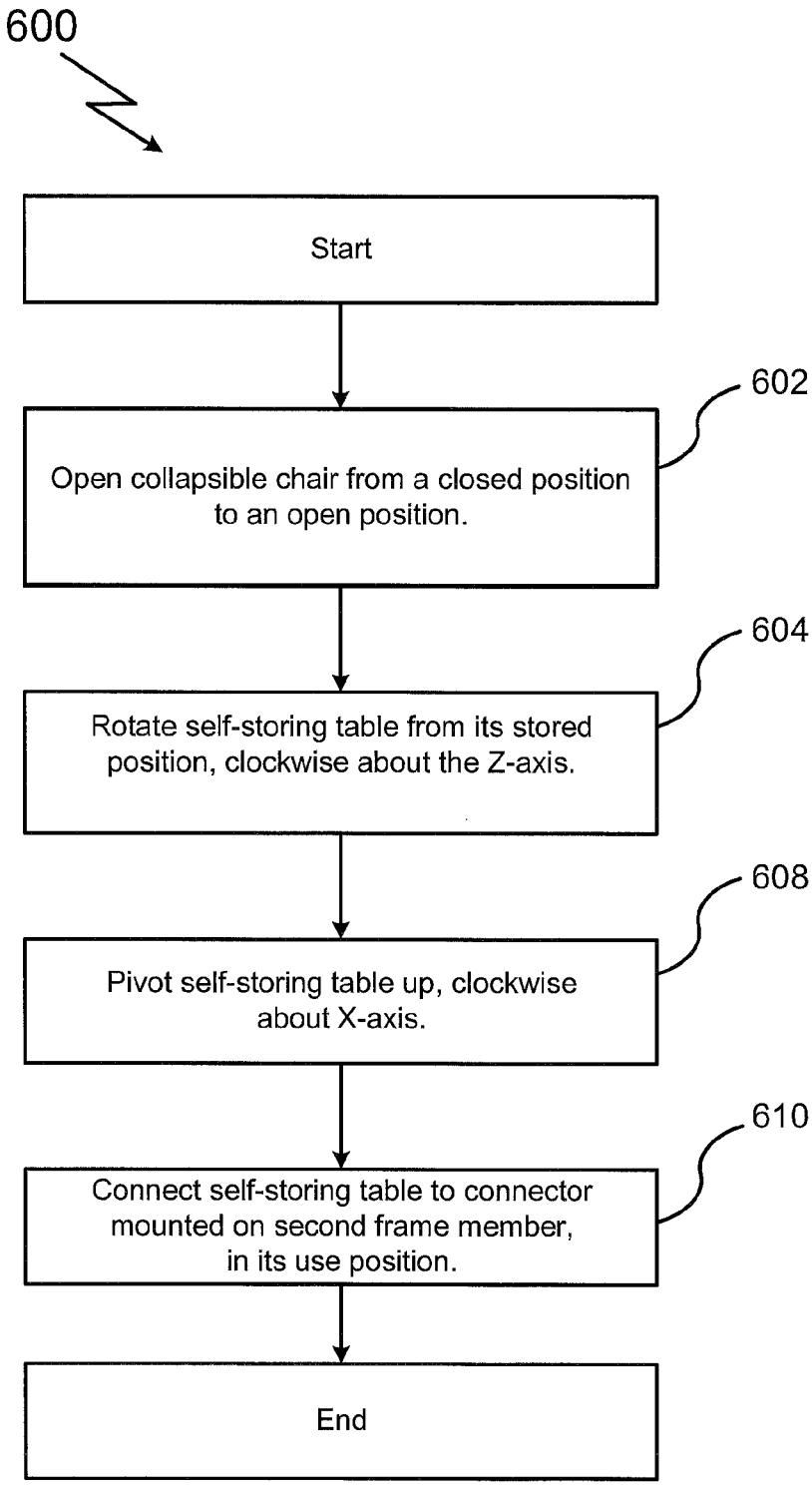
FIG. 6 illustrates a flow diagram of an approach for opening a collapsible chair of FIG. 1 having a self-storing table in accordance with another embodiment of the invention.

In FIG. 6, an illustration of a flow diagram 600 of an approach for opening a collapsible chair 102 of FIG. 1 having a self-storing table 104 in accordance with another embodiment of the invention. The collapsible chair 102 starts in a closed position and is opened 602. The self-storing table 104 is pulled out from its stored position under the collapsible chair 102 by rotating it clockwise about Z-axis 402 (frame member 106) in step 604. The self-storing table 104 is then pivoted up or clockwise 608 and connected by connector 110 to the frame member 112 of the collapsible chair 102 in step 610, to its use position.

In general, terms such as "coupled to," and "configured for coupling to" and "secured to" (for example, a first component is "coupled to" or "is configured for coupling to" or is "secured to" a second component) are used herein to indicate a structural, functional, mechanical, electrical, signal, optical, magnetic, electromagnetic, ionic or fluidic relationship between two or more components or elements. As such, the fact that one component is said to couple to a second component is not intended to exclude the possibility that additional components may be present between, and/or operatively associated or engaged with, the first and second components.

Although the previous description only illustrates a particular example of an implementation, the invention is not limited to the foregoing illustrative examples. A person skilled in the art is aware that the invention as defined by the appended claims can be applied in various further implementations and modifications. For example, the tray table of the present invention may be applied to other folding chairs without departing from the scope of the invention. Accordingly, the foregoing description of an implementation has been presented for purposes of illustration and description. It is not exhaustive and does not limit the claimed invention to the precise form disclosed. Modifications and variations are possible in light of the above description or may be acquired from practicing the invention. The claims and their equivalents define the scope of the invention.

What is claimed is:

1. A collapsible chair with an open position and a closed position, comprising:

a leg frame with at least a first member and a second member;

a self-storing table that is pivotally connected at a first end to the first frame member; and a connector located on the second frame member, the connector being connected to a second end of the self-storing table when the self-storing table is in a first position and the chair is in the open position, and disconnected from to the self-storing table when the self-storing table is rotated to a second position.

2. The collapsible chair of claim 1, where the self-storing table is molded plastic.

3. The collapsible chair of claim 1, where the self-storing table has a cup holder.

4. The collapsible chair of claim 3, where the cup holder is removable.

5. The collapsible chair of claim 1, where the connector is a metal bolt.

6. The collapsible chair of claim 1, where rotating the self-storing table to the second position allows the chair to be collapsed to the closed position.

7. The collapsible chair of claim 1, where the first frame member and the second frame member are composed of aluminum.

8. The collapsible chair of claim 1, where a bracket pivotally connects the self-storing table to the first frame member.

9. The collapsible chair of claim 8, where a bracket enables the self-storing table to simultaneously pivot about a first axis and rotate about a second axis transverse to the first axis.

10. The collapsible chair of claim 8, where the first axis is a central axis of the first frame member.

11. A method for attaching a self-storing table to a collapsible chair, comprising:

pivotally connecting a first corner of a self-storing table permanently to a first frame member of a collapsible chair; and detachably coupling with a connector a second corner of the self-storing table to a second frame member, when the collapsible chair is in an open position.

12. The method of claim 11, where connecting further includes, moving the self-storing table from a second stored position to a first connected position.

13. The method of claim 12, where the bracket enables the self-storing table to simultaneously pivot about a first axis and rotate about a second axis transverse to the first axis.

14. The method of claim 12, where the first axis is a central axis of the first frame member.

15. The method of claim 11, where the connector is a metal bolt.

16. The method of claim 11, where the self-storing table has a cup holder.

17. The method of claim 11, where the first frame member and the second frame member are made from aluminum.

18. The method of claim 11, where the self-storing table is made from plastic.

19. The method of claim 11, where pivotally connecting further includes securing a bracket to the first frame member and the self-storing table.

20. The collapsible chair of claim 8, where the self-storing table may be rotated between a first position wherein the self-storing table extends outwardly from the leg frame and a second position wherein the self-storing table is stored under a seat portion of the chair.

* * * * *